US012696981B2

(12) United States Patent
King et al.

(10) Patent No.: US 12,696,981 B2
(45) Date of Patent: Aug. 4, 2026

(54) SUPPORT UNIT FOR USE ON AN ARTICLE OF FURNITURE

(71) Applicant: King Furniture Australia Pty Ltd., Turrella (AU)

(72) Inventors: David King, Turrella (AU); Anastasie Panagopoulos, Turrella (AU); David Hardwick, Turrella (AU)

(73) Assignee: King Furniture Australia Pty Ltd., Turrella (AU)

( * ) Notice: Subject to any disclaimer, the term of this patent is extended or adjusted under 35 U.S.C. 154(b) by 0 days.

(21) Appl. No.: 17/909,347

(22) PCT Filed: Mar. 2, 2021

(86) PCT No.: PCT/AU2021/050177
§ 371 (c)(1),
(2) Date: Sep. 2, 2022

(87) PCT Pub. No.: WO2021/174296
PCT Pub. Date: Sep. 10, 2021

(65) Prior Publication Data

US 2023/0084252 A1 Mar. 16, 2023

(30) Foreign Application Priority Data

Mar. 4, 2020 (AU) ..... 2020900650

(51) Int. Cl.
*A47C 7/38* (2006.01)
*A47C 7/42* (2006.01)
*A47C 20/02* (2006.01)

(52) U.S. Cl.
CPC ..... *A47C 7/383* (2013.01); *A47C 7/425* (2013.01); *A47C 20/027* (2013.01)

(58) Field of Classification Search
CPC ..... A47C 7/383; A47C 7/425; A47C 20/027
See application file for complete search history.

(56) References Cited

U.S. PATENT DOCUMENTS 2,592,702 A * 4/1952 Lowry ..... B60N 2/787 297/411.32
2,661,050 A * 12/1953 Felter ..... B60N 2/882 297/391

(Continued)

FOREIGN PATENT DOCUMENTS

CN 106889801 A 6/2017
EP 0895737 A1 2/1999

(Continued)

OTHER PUBLICATIONS

International Search Report for Application No. PCT/AU2021/050177 dated Apr. 20, 2021, 5 pages.

*Primary Examiner* — Philip F Gabler
(74) *Attorney, Agent, or Firm* — Banner & Witcoff, Ltd.

(57) ABSTRACT

A support unit for use on an article of furniture includes an adjustable support structure displacably mountable to the article of furniture and a cushion member carried by the support structure. The support structure is configured to be arranged in a first orientation relative to the article of furniture for enabling the cushion member to adopt a first position relative to the article of furniture and in a second orientation (46) relative to the article of furniture for enabling the cushion member to adopt a second position relative to the article of furniture.

10 Claims, 3 Drawing Sheets

(56) References Cited

U.S. PATENT DOCUMENTS

| | | | | |
|---|---|---|---|---|
| 5,171,064 | A | 12/1992 | Boussaroque | |
| 8,590,080 | B1 * | 11/2013 | Staresinic | A47C 21/00 5/430 |
| 8,851,573 | B2 * | 10/2014 | Klokk | B60N 2/85 297/391 |
| 10,118,526 | B1 * | 11/2018 | Fan | B60N 2/882 |
| 10,517,406 | B2 * | 12/2019 | McAlpine | A47C 17/37 |
| D1,007,163 | S * | 12/2023 | King | D6/334 |
| 2019/0021503 | A1 * | 1/2019 | Lu | F16H 21/50 |
| 2019/0223606 | A1 * | 7/2019 | Hesse | B60N 2/821 |

FOREIGN PATENT DOCUMENTS

| | | | |
|---|---|---|---|
| IT | 20080171 | | 3/2010 |
| IT | MC20080171 | * | 3/2010 |
| KR | 20100092803 A | | 8/2010 |

* cited by examiner

SUPPORT UNIT FOR USE ON AN ARTICLE OF FURNITURE

CROSS-REFERENCE TO RELATED APPLICATIONS

The present application is a U. S. National Phase Entry of International Application No. PCT/AU2021/050177 filed Mar. 2, 2021, designating the United States of America and claiming priority to Australian Application No 2020900650 filed Mar. 4, 2020. The present application claims priority to and the benefit of the above-identified applications and the above-identified applications are incorporated by reference herein in their entirety.

TECHNICAL FIELD

The present disclosure relates, generally, to furniture accessories, and, more particularly, to a support unit for use on an article of furniture.

BACKGROUND

Articles of furniture can be enhanced through the use of accessories, which can improve the aesthetics and/or function of the articles of furniture. However, providing many functional accessories for the articles of furniture can increase clutter, create storage issues and be costly to implement.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each of the appended claims.

SUMMARY

In an aspect of the present disclosure, there is provided a support unit for use on an article of furniture, the support unit comprising: an adjustable support structure displaceably mountable to the article of furniture; and a cushion member carried by the support structure, the support structure being configured to be arranged in a first orientation relative to the article of furniture for enabling the cushion member to adopt a first position relative to the article of furniture and in a second orientation relative to the article of furniture for enabling the cushion member to adopt a second position relative to the article of furniture.

The article of furniture may comprise a seat cushion, a back rest, and a back cushion, and the support structure may comprise a frame and a support element displaceably arranged relative to the frame. The support element may be pivotally coupled to the frame.

The support element may be movable to a first configuration relative to the frame for mounting the support structure in the first orientation, such that at least a part of the support structure is configured to follow a periphery of the back rest of the article of furniture for the cushion member to adopt the first position in which the cushion member functions as a bolster to provide support to the back cushion of the article of furniture.

The support element may be movable to a second configuration relative to the frame for mounting the support structure in the second orientation, such that at least a part of the support structure is configured to follow a periphery of the back cushion of the article of furniture for the cushion member to adopt the second position in which the cushion member functions as a head rest. At least a part of the support structure, when the support structure in the second orientation, is configured to impart support to the back cushion of the article of furniture.

At least a part of the support structure may be receivable between the seat cushion and the back rest of the article of furniture.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF DRAWINGS

Embodiments of the disclosure will now be described by way of example only with reference to the accompany drawings in which.

DESCRIPTION OF EMBODIMENTS

Figure 2:
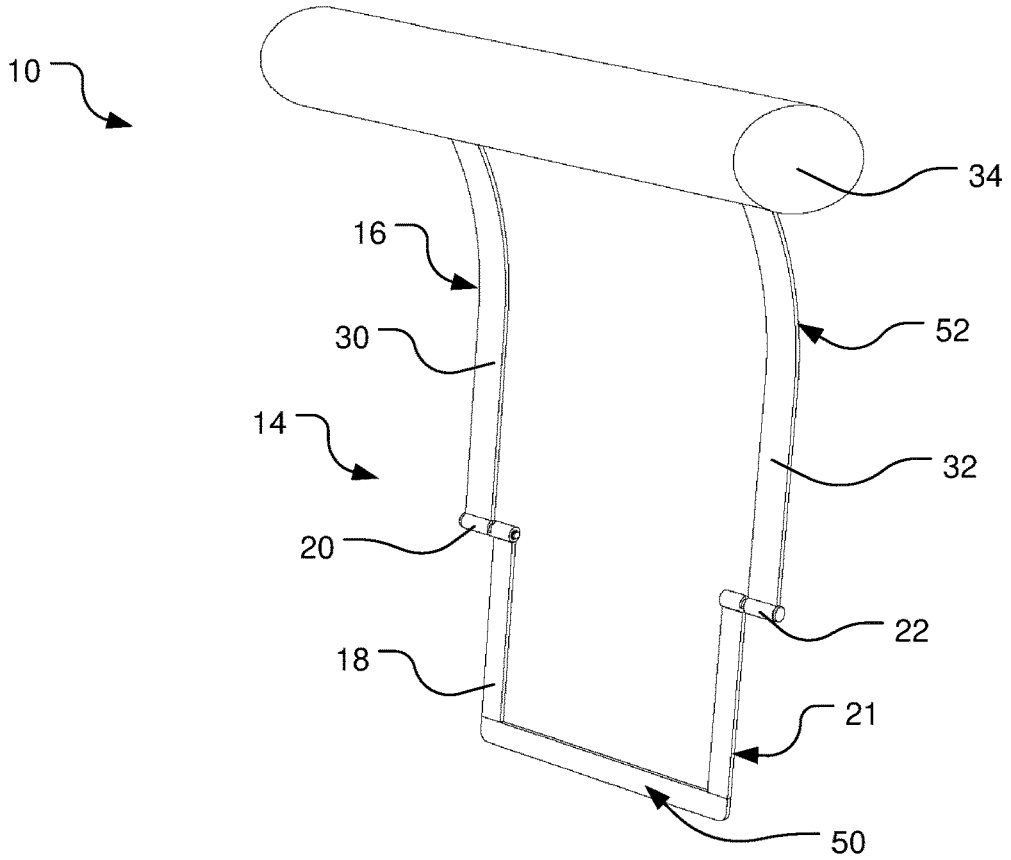
FIG. 2 shows a perspective view of the support unit shown in FIG. 1, with the support element being shown in a second configuration.
Figure 3:
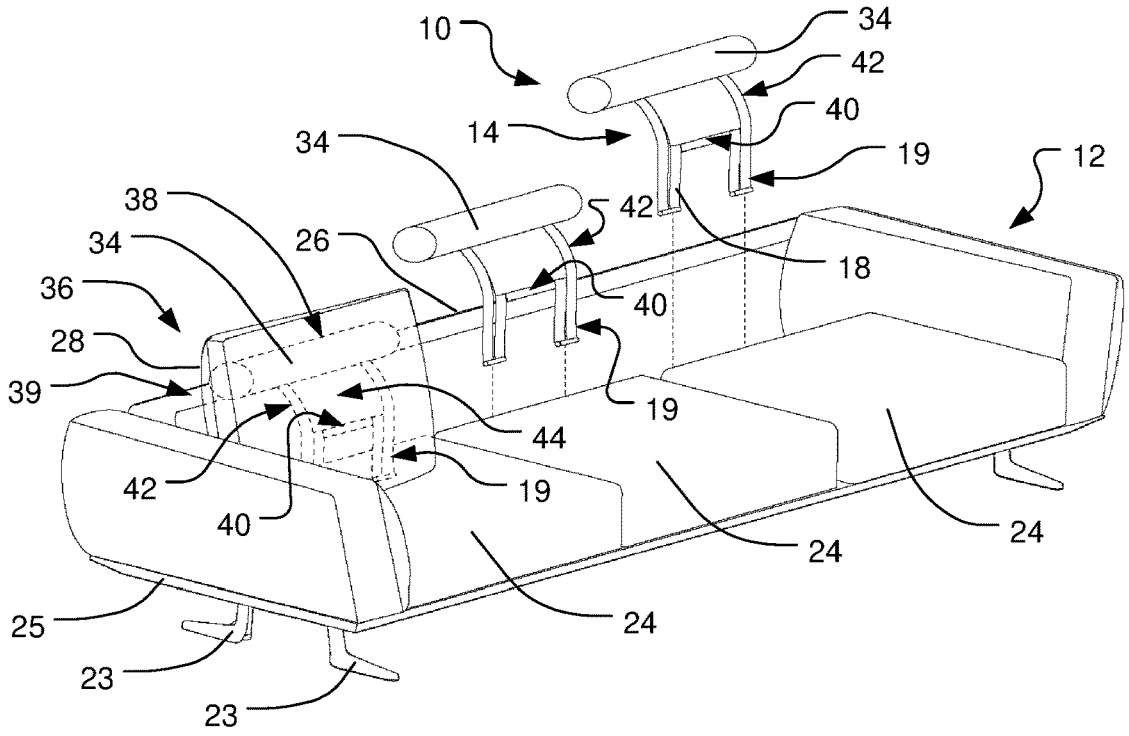
FIG. 3 shows a front, perspective view of the support unit shown in FIG. 1 in use on a sofa, with the support structure in a first orientation relative to the sofa.
Figure 4:
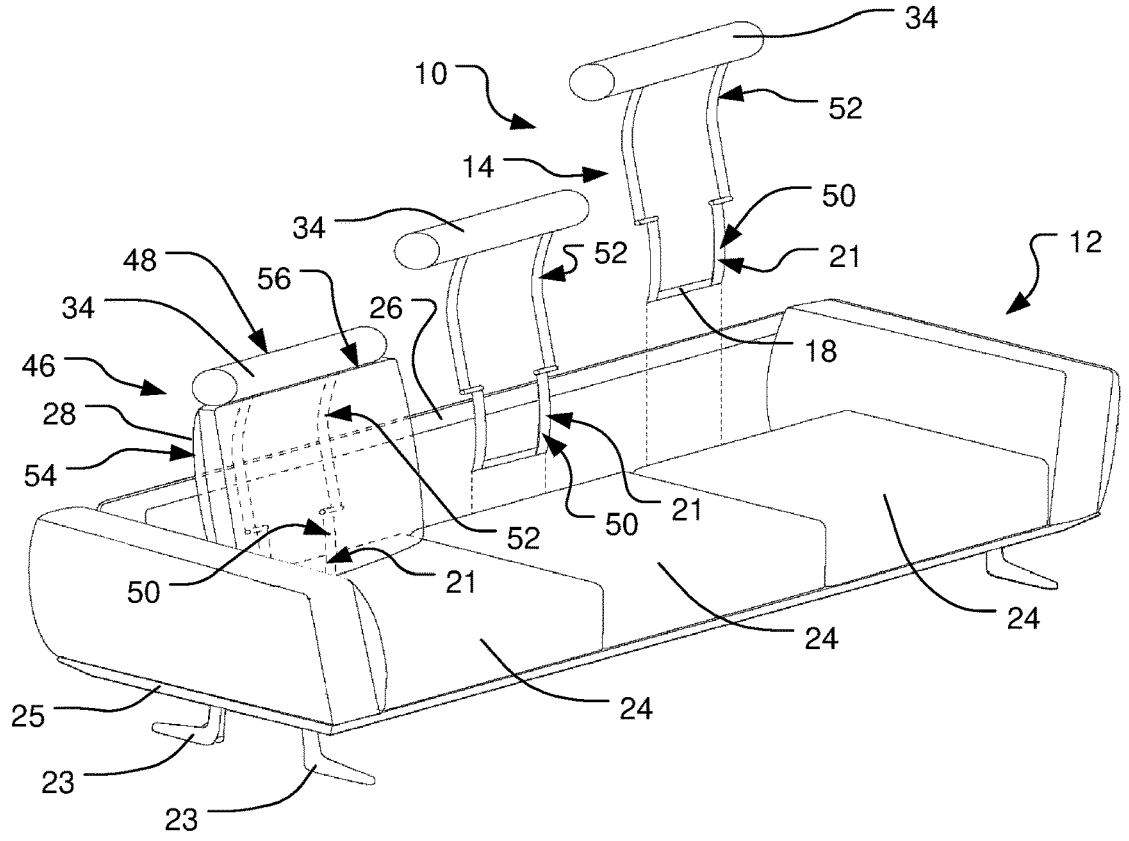
FIG. 4 shows a front, perspective view of the support unit shown in FIG. 2 in use on the sofa, with the support structure in a second orientation relative to the sofa.
Figure 5:
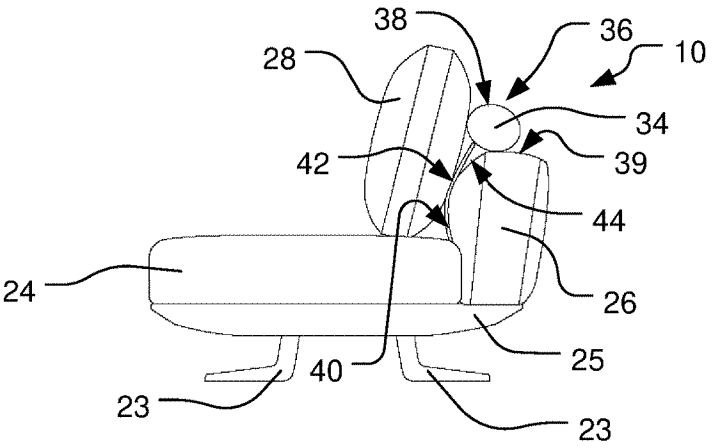
FIG. 5 shows a side view of the support unit in use on a sofa in the first orientation.

In the drawings, reference numeral 10 generally designates a support unit 10 (FIGS. 1 and 2) for use on an article of furniture, such as a sofa 12 (FIGS. 3-5). The support unit 10 includes an adjustable support structure 14 and a cushion member 34 carried by the support structure 14. The support structure 14 is in the form of a frame 16 with a support element 18 displaceably arranged relative to the frame 16. In this embodiment, the support element 18 is pivotally coupled to the frame 16 at pivot points 20, 22. However, it will be appreciated that the support structure 14 may be adjustable via any other suitable means, for example, a telescopic arrangement and/or a modular arrangement.

The frame 16 comprises two laterally spaced legs 30, 32 which are curved for following a periphery or contour of a part of the sofa 12 as described in more detail below. The laterally spaced legs 30, 32, in combination with the support element 18, allows the support structure 14 to be mounted to, or removed from, the sofa 12. Specifically, at least a part 19, 21 of the support structure 14 is removably receivable between the seat cushion 24 and the back rest 26 of the sofa 12 to mount the support structure 14 to the sofa 12. In this way, the support structure 14 is displaceably mountable to the article of furniture 12. It will be appreciated that the support structure 14 may be of any suitable shape and comprise any suitable elements for displaceably mounting the support structure 14 to the sofa 12. It will also be appreciated that the legs 30, 32 may instead be formed in one or more rectilinear portions to follow a rectilinear periphery of part of an article of furniture.

In this embodiment, the sofa 12 includes legs 23 and a base 25 supporting a plurality of seat cushions 24. A back rest 26 extends operatively upwardly from the base 25. The back rest 26 supports a plurality of back cushions 28, there being the same number of back cushions 28 as there are seat cushions 24. It will be appreciated that, while the illustrated embodiment shows a three seater sofa, the appropriate number of support units 10 could equally applicably be used with a 2 seater sofa, a chair, a chaise, or the like While the illustrated embodiment shows one support unit 10 per seat cushion 24, the support unit 10 is modular in nature and can be placed anywhere relative to the back rest 26. Thus, if the sofa comprised one continuous seat portion, one or more support units 10 may be provided to be placed at any desired location along the back rest 26 of the sofa 12. The one or more support units 10 may each have a back cushion 28 associated with them.

As best shown in FIGS. 3 and 5, the support structure 14 is configured to be arranged in a first orientation 36 relative to the sofa 12 for enabling the cushion member 34 to adopt a first position 38 relative to the sofa 12. In this first position 38, the cushion member 34 functions as a bolster. To allow the support structure 14 to be arranged in the first orientation 36, the support element 18 is arranged in a first configuration 40 in which the support element 18 is pivoted to be located between within the frame 16 between the legs 30, 32 of the frame 16. The cushion member 34, functioning as a bolster, provides support to its associated back cushion 28 of the sofa 12.

As indicated above, to assist with arranging the support structure 14 in the first orientation 36, at least a part 42 of the support structure 14 is configured to follow a periphery, contour, 44 (FIG. 5) of the back rest 26 of the sofa 12. This arrangement, along with at least the part 19 being received between the seat cushion 24 and the back rest 26 of the sofa 12, provides a suitable surface area for a frictional engagement between the support structure 14 and the sofa 12. Further, as best shown in FIG. 5, when the cushion member 34 functions as a bolster, the cushion member 34 bears against an operatively top portion 39 of the back rest 26 of the sofa 12. This assists in locating the cushion member 34 in its first position 38 relative to the sofa 12.

As best shown in FIG. 4, the support structure 14 is also configured to be arranged in a second orientation 46 relative to the sofa 12 for enabling the cushion member 34 to adopt a second position 48 relative to the sofa 12. In this second position 48, the cushion member 34 functions as a head rest. To allow the support structure 14 to be arranged in the second orientation 46, the support element 18 is arranged in a second configuration 50 in which the support element 18 is pivoted from its first configuration 40 to extend operatively downwardly from the pivot points 20, 22 of the frame 16.

Once again, as indicated above, to assist with arranging the support structure 14 in the second orientation 46, at least a part 52 of the support structure 14 is configured to follow a periphery, or contour, 54 (FIG. 4) of the back cushion 28 of the sofa 12. This arrangement, along with at least the part 21 being receivable between the seat cushion 24 and the back rest 26 of the sofa 12, provides a suitable surface area for a frictional engagement between the support structure 14 and the sofa 12. Further, when the support structure 14 is in the second orientation 46, at least a part of the legs 30, 32 of the frame 16 of the support structure 14 of the unit 10, impart a measure of support to the back cushion 28 to inhibit folding of the back cushion 28 over the top of the back rest 26 of the sofa 12.

As shown in FIG. 4, when the cushion member 34 functions as a head rest, the cushion member 34 bears against an operatively top portion 56 of the back cushion 28 of the sofa 12. This assists in locating the cushion member 34 in the second position 48. It will be appreciated that, in some embodiments, at least a part of the support element 18, when in its second configuration 50, is shaped to follow the periphery 44 of the back rest 26 of the sofa 12. This increases the surface area for frictional engagement between the support structure 14 and the sofa 12 in the second orientation 46.

Figure 1:
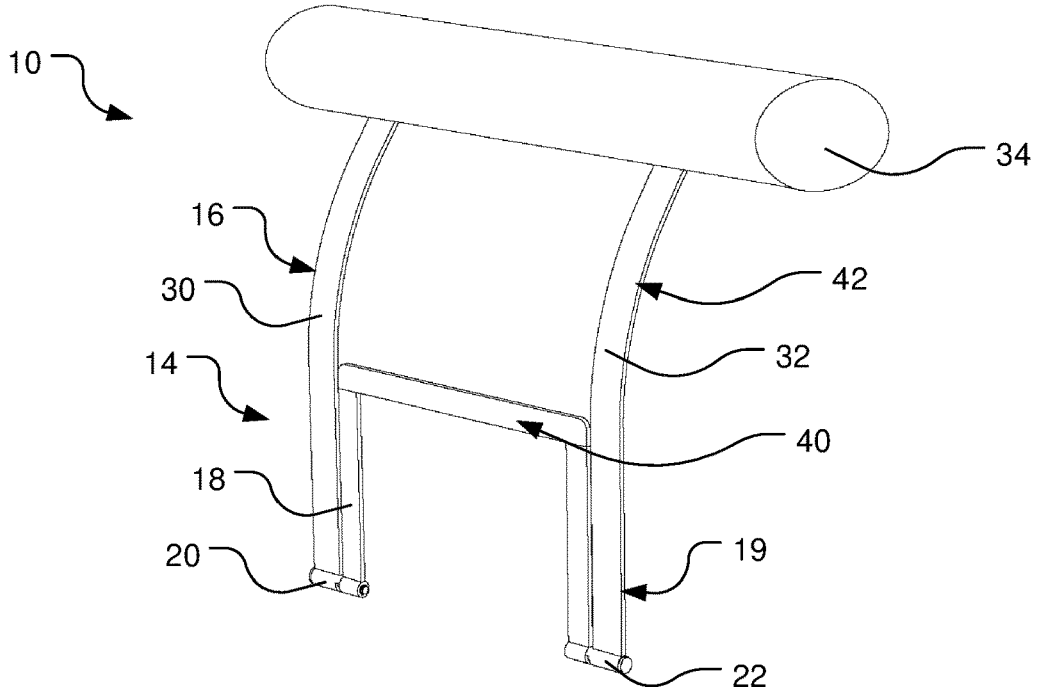
FIG. 1 shows a perspective view of an embodiment of a support unit for use on an article of furniture, with a support element of a support structure of the support unit being shown in a first configuration.
Figure 6D:
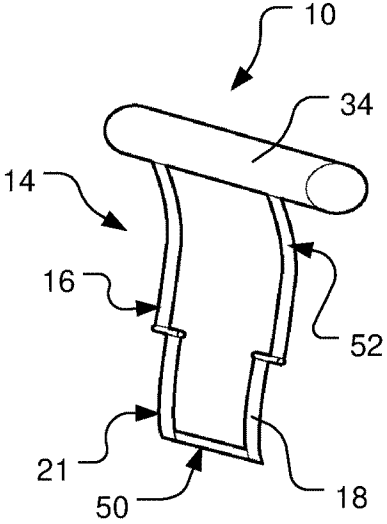
FIGS. 6A-6D show an embodiment of a method of use of the support unit illustrating conversion of the support unit from the first orientation as shown in FIG. 3 to the second orientation as shown in FIG. 4.
Figure 6C:
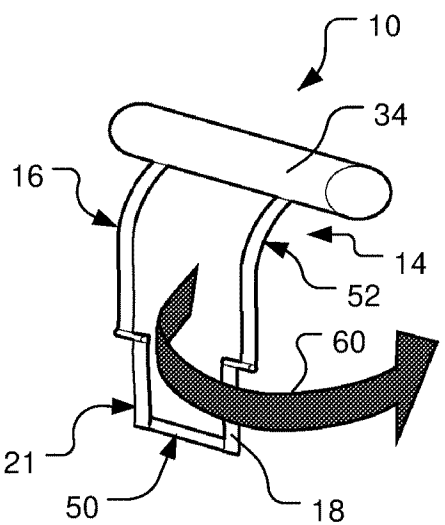
Figure 6B:
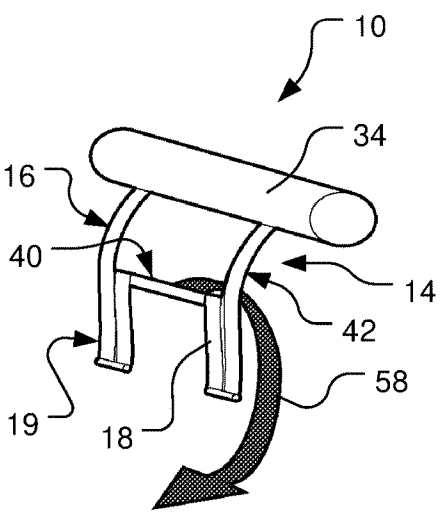
Figure 6A:
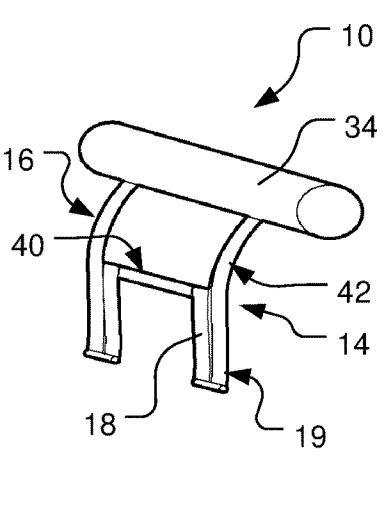

Thus, in use, the support structure 14 of the support unit 10 may initially be arranged in the first orientation 36 as shown in FIGS. 1 and 6A. With reference to FIG. 3, the user may mount the support structure 14, in its first orientation 36, to the sofa 12 by inserting at least the part 19 of the support structure 14 between the seat cushion 24 and the back rest 26, such that the cushion member 34 bears against the operatively top portion 39 of the back rest 26 of the sofa 12. This locates the cushion member 34 in the first position 38. The back cushion 28 may then be applied to the sofa 12 such that it bears against the cushion member 34 in the first position 38 for the cushion member 34 to act as a bolster for the back cushion 28. In this way, a user resting against the back cushion 28 will be supported, since folding or crimping of the back cushion 28 due to the applied weight of the user will be reduced by the cushion member 34 acting as a bolster.

Should the user wish to use the support unit 10 as a head rest, the user first lifts the support structure 14 out from between the seat cushion 24 and the back rest 26 of the sofa 12. The user then follows the steps shown schematically in FIGS. 6A-6D. Starting with the support element 18 in its first configuration 40, as shown in FIG. 6A, the user pivots the support element 18 in the direction of curved arrow 58 as shown in FIG. 6B, such that the support element 18 moves to its second configuration 50 as shown in FIG. 6C. Once the support element 18 has been moved to its second configuration 50, the user rotates the support unit 10 about a longitudinally extending, bisecting axis (not shown) in the direction of curved arrow 60 as shown in FIG. 6C to adopt the position shown in FIG. 6D, such that the support structure 14 is in position to be arranged in the second orientation 46 (FIG. 4).

With reference to FIG. 4, the user mounts the support structure 14 in the second orientation 46 to the sofa 12 by inserting at least the part 21 of the support structure 14 between the seat cushion 24 and the back rest 26. In this second orientation 46, the cushion member 34 bears against the operatively top portion 39 of the back cushion 28 of the sofa 12 to function as the head rest.

If the user wishes to use the support unit 10 as a bolster once again, they would follow the steps of the method of use in reverse, that is, starting from FIG. 6D and following the curved arrows 58, 60 in reverse to convert the support unit 10 to the configuration as shown in FIG. 6A, ready to be arranged in the first orientation 36.

Advantageously, the support unit 10 acts as an accessory to the sofa 12 with two functions in a single article; the first function being to act as a bolster for the back cushion 28 of the sofa 12, and the second function being to act as a head rest for the user. In addition, the displaceability of the support unit 10 allows the user the choice of whether to apply the support unit 10 as a head rest or bolster, or whether to store the support unit 10 for a less cluttered aesthetic for the sofa 12. In some embodiments, the support element 18 being pivotally connected to the frame 16, allows the user to store the support unit 10 in the more compact first orientation 36 by moving the support element 18 to its first configuration 40.

It will be appreciated by persons skilled in the art that the support structure 14 may be formed in any suitable manner, such as the use of a solid panel instead of the frame 16 with legs 30, 32. Further, the support element 18 may also embody any suitable form, such as a solid panel displaceably arranged relative to the frame 16 or relative to the said solid panel embodiment of the frame 16. Further, it will be appreciated that a part the support structure 14 may be attached to the sofa 12, and it will also be appreciated that the support unit 10 may be applicable to other articles of furniture, such as an armchair, a bed frame, an office chair, or the like.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A support unit for use on an article of furniture, wherein the article of furniture comprises a seat cushion, a back rest, and a back cushion, the support unit comprising:

an adjustable support structure displaceably mountable to the article of furniture, the support structure comprising:

a frame comprising:

a first face;

a second face opposite the first face;

an operatively upper end; and an operatively lower end; and a support element displaceably arranged relative to the frame so as to be displaceable between a first configuration relative to the frame and a second configuration relative to the frame, wherein the support element extends from the operatively lower end of the frame in the second configuration and is retracted in the first configuration, and wherein the support element is in a common plane with that of an operatively lower end portion of the frame in both the first configuration and the second configuration; and a cushion member fixedly connected to the operatively upper end of the frame, the cushion member being offset from the common plane in a direction extending away from the first face, such that:

in use, with the support element in the first configuration and the support structure engaged between the back rest and the back cushion with the first face facing the back rest and the second face facing the back cushion: (i) the support element and at least the operatively lower end portion of the frame are configured to follow a periphery of the back rest of the article of furniture; and (ii) the cushion member extends operatively rearwardly relative to the common plane to adopt a first position in which the cushion member functions as a bolster by engaging a rear surface of the back cushion to provide support to the back cushion of the article of furniture; and in use, with the support element in the second configuration and the support structure engaged between the back rest and the back cushion with the second face facing the back rest and the first face facing the back cushion: (i) the support element and at least the operatively lower end portion of the frame are configured to follow a periphery of the back cushion of the article of furniture; (ii) the cushion member extends operatively forwardly relative to the common plane to adopt a second position in which the cushion member functions as a head rest by extending to a location adjacent a top of the back cushion; and (iii) at least a part of the support structure is configured to impart support to the back cushion of the article of furniture, the imparted support including inhibiting folding of the back cushion over the top of the back rest.

2. The support unit according to claim 1, wherein the support element is pivotally coupled to the operatively lower end of the frame.

3. The support unit according to claim 1, wherein the cushion member is cylindrical shaped.

4. The support unit according to claim 1, wherein an operatively upper portion of the frame curves away from the common plane.

5. An article of furniture comprising:

a base;

a back rest extending operatively upwardly from the base;

a back cushion located operatively forwardly of the back rest; and a support unit for use on the article of furniture, the support unit comprising:

an adjustable support structure engageable between the back rest and the back cushion, the support structure comprising:

a frame comprising:

a first face;

a second face opposite the first face;

an operatively upper end; and an operatively lower end; and a support element displaceably arranged relative to the frame so as to be displaceable between a first configuration relative to the frame and a second configuration relative to the frame, wherein the support element extends from the operatively lower end of the frame in the second configuration and is retracted in the first configuration, and wherein the support element is in a common plane with that of an operatively lower end portion of the frame in both the first configuration and the second configuration; and a cushion member fixedly connected to the operatively upper end of the frame, the cushion member being offset from the common plane in a direction extending away from the first face, such that:

in use, with the support element in the first configuration and the support structure engaged between the back rest and the back cushion with the first face facing the back rest and the second face facing the back cushion: (i) the support element and at least the operatively lower end portion of the frame are configured to follow a periphery of the back rest of the article of furniture; and (ii) the cushion member extends operatively rearwardly relative to the common plane to adopt a first position in which the cushion member functions as a bolster by engaging a rear surface of the back cushion to provide support to the back cushion of the article of furniture; and in use, with the support element in the second configuration and the support structure engaged between the back rest and the back cushion with the second face facing the back rest and the first face facing the back cushion: (i) the support element and at least the operatively lower end portion of the frame are configured to follow a periphery of the back cushion of the article of furniture; (ii) the cushion member extends operatively forwardly relative to the common plane to adopt a second position in which the cushion member functions as a head rest by extending to a location adjacent a top of the back cushion; and (iii) at least a part of the support structure is configured to impart support to the back cushion of the article of furniture, the imparted support including inhibiting folding of the back cushion over the top of the back rest.

6. The article of furniture according to claim 5, wherein, in use, at least a part of the support structure is located between the seat cushion and the back rest of the article of furniture.

7. The article of furniture according to claim 6, wherein the support element is pivotally coupled to the operatively lower end of the frame.

8. The article of furniture according to claim 5, wherein the support element is pivotally coupled to the operatively lower end of the frame.

9. The article of furniture according to claim 5, wherein the cushion member is cylindrical shaped.

10. The article of furniture according to claim 5, wherein an operatively upper portion of the frame curves away from the common plane.

* * * * *